United States Patent [19]

Bernstein

[11] Patent Number: 4,837,546

[45] Date of Patent: Jun. 6, 1989

[54] FUSE BLOCK

[75] Inventor: Elliot Bernstein, Glen Cove, N.Y.

[73] Assignee: Bel Fuse Inc., Jersey City, N.J.

[21] Appl. No.: 166,705

[22] Filed: Mar. 11, 1988

[51] Int. Cl.[4] ..... H01H 85/04

[52] U.S. Cl. ..... 337/272; 337/201; 337/250

[58] Field of Search ..... 337/186, 191, 198, 201, 337/202, 203, 213, 216, 227, 228, 246, 249, 250, 272

[56] References Cited

U.S. PATENT DOCUMENTS 426,156 4/1890 Warrell ..... 337/203

2,292,907 8/1942 Sperling ..... 337/272

*Primary Examiner*—H. Broome

*Attorney, Agent, or Firm*—Ostrolenk, Faber, Gerb & Soffen

[57] ABSTRACT

A fuse block with a fuse formed of a single piece of fusible metal having a narrowed mid-section and wider end tongues which electrically couple the fuse block to disconnect terminals of an electrical system. A plastic housing covers the portions of the tongue adjoining the mid-section. The housing has a central aperture exposing all sides of the narrowed mid-section of the fusible element to the air. The aperture prevents the housing from acting as a heat sink for the fusible element and from interfering with the prompt reaction of the fuse to an electrical overload.

16 Claims, 2 Drawing Sheets

FIG. 8.
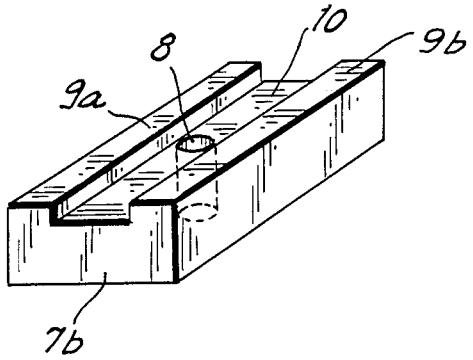
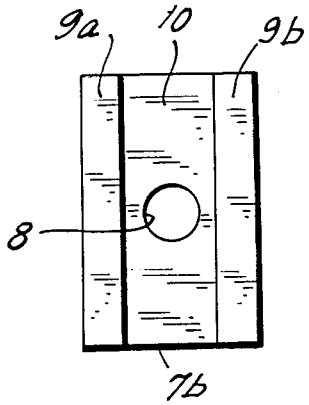
FIG. 6.
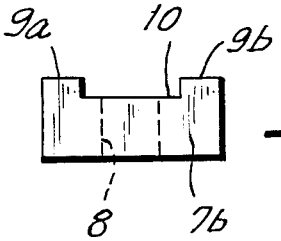
FIG. 7.

FUSE BLOCK

BACKGROUND OF THE INVENTION

1. Field of the Invention

The present invention relates to a fuse block and more particularly to a fuse block of simple construction, just a fusible metal strip and a housing, and which can be coupled to an electrical system.

2. Description of the Related Art

Electrical fuses are used in electrical systems to prevent damage to the system from electrical overload. For example, fuses are used in electrical systems for small electric appliances, including battery operated ones. An electrical fuse includes a fusible metallic strip portion whose electrical resistance causes it to heat upon transmitting an electrical overload and whose materials and cross-sectional size and shape cause it to fuse and melt and separate during an overload condition exceeding particular amperages for specified time periods.

A circuit breaker or interrupter device may be used in the electrical system to protect it. Typically, a circuit breaker comprises a reclosable electrical switch that is tripped open when the circuit breaker is electrically overloaded. After the overload is cleared, the circuit breaker may be reset and its electrical switch reclosed. A reusable unit can be more expensive than required or desired, especially if the circuit interruption is rarely if ever to occur. In that case, a preferably less expensive fuse is used.

A fuse includes electrical terminals for connection into the circuit to be protected and a fusible metal strip connected between the terminals. The strip is supported in a housing, or the strip is at least mechanically connected with its terminals, because the strip cross-section may make it weak and because when the metal strip fuses, the mechanical integrity of the fuse block should be maintained. The metal strip is often encapsulated, inside a protective housing, e.g. a tube of glass, or the like. The housing can act as an undesirable or unpredictable heat sink. It certainly requires additional housing fabrication and fuse assembly steps and material and labor costs.

Need has existed for a compact, simple, easily installed fuse with few components, one that may be used for a small battery-operated electrical system, for example.

SUMMARY OF THE INVENTION

Accordingly, an object of the present invention is to provide a compact, easily installed, inexpensive electrical fuse.

Another object is to provide such a fuse having a minimal number of components, requiring minimal fabrication and assembly steps.

Another object is to provide a fuse which can operate as a backup, e.g. in series circuit with, a circuit breaker.

Yet another object is to provide such a fuse which is adapted for use in a small battery-operated electrical system.

A further object is to provide a fuse which reacts promptly to an electrical overload.

Another object is to avoid the fuse housing acting as a heat sink.

A still further object is to provide a fuse which connects to quick disconnect terminals provided in an electrical system.

These and other objects of the present invention are achieved by a fuse comprising a specially configured single piece of fusible metal having a reduced cross-section, fusible or meltable mid-section and two tongues which are adjacent and preferably integral with the mid-section and define the terminals of the fuse. The fuse also includes a housing which extends past without contacting the reduced cross-section mid-section and covers the adjacent portions of the adjacent tongues. The housing maintains the integrity of the fuse when the fusible medal mid portion fuses and melts upon overload. A central aperture passes through the housing and exposes all sides of the mid-section of the strip so that the housing does not serve as a heat sink which would diminish the promptness and predictability of the reaction to an excess overload. The housing is of appropriate electrical and heat nonconductive material.

The fuse may be easily inserted into and removed from the electrical system by snapping the tongues of the fuse block into respective quick disconnect terminals of the electrical system. The invention thus can protect appliances using the electrical system in a quick, easy manner.

Other features and advantages of the present invention will become apparent from the following description of the invention which refers to the accompanying drawings.

BRIEF DESCRIPTION OF THE DRAWINGS

FIG. 6 shows a top view of the lower piece of the housing of the fuse block.

FIG. 7 shows an end view of the lower piece of the housing of the fuse block.

FIG. 8 shows a perspective view of the lower piece of the housing of the fuse block.

DETAILED DESCRIPTION OF THE PREFERRED EMBODIMENTS

Figure 1:
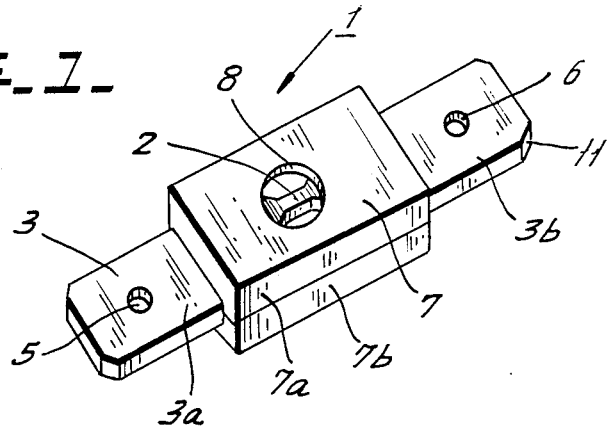
FIG. 1 shows a perspective view of the fuse block of the present invention.
Figure 2:
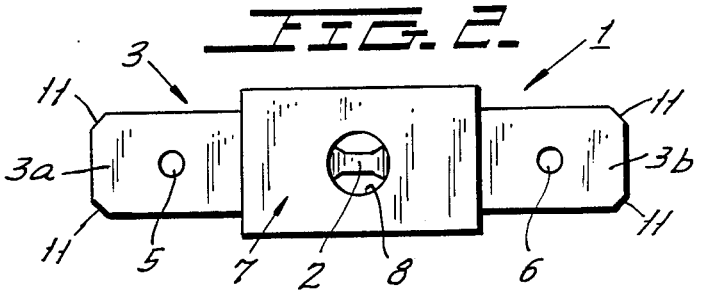
FIG. 2 shows a top view of the fuse block.
Figure 4:
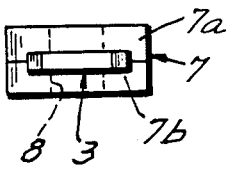
FIG. 4 shows an en view of the fuse block.
Figure 3:
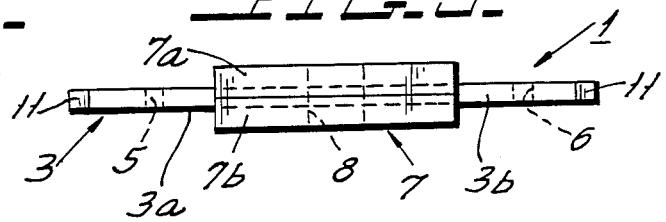
FIG. 3 shows a side view of the fuse block.

Referring to FIG. 1, the fuse block 1 of the present invention is comprised of a single piece of fusible metal 3 supported in a single piece, preferably molded plastic, housing 7 for maintaining the integrity of the fuse. It is a basic, simple, two component fuse.

Figure 5:
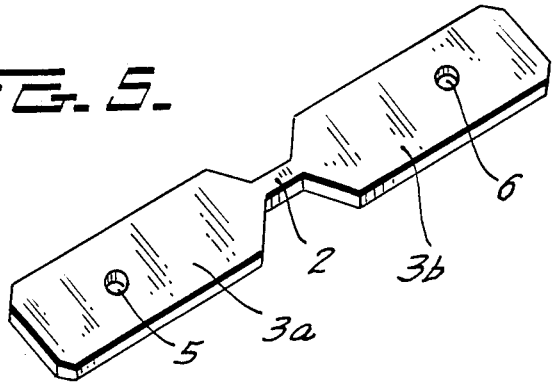
FIG. 5 shows a perspective view of the single piece of fusible metal utilized in the fuse block.

As seen in FIG. 5, the single piece fusible metal 3 is "butterfly" shaped It may be comprised of any known fusible metal such as zinc. It has two tongues, 3*a* and 3*b*, which serve as respective connectors for joining the fuse into an electrical circuit (not shown) to be protected by the fuse Tongues 3*a* and 3*b* are wide enough and thick enough and are shaped to provide relatively easy mounting in cooperatingly shaped, quick disconnect female terminals (not shown) formed in the electrical circuit. The tongues 3*a* and 3*b* are generally flat rectangular pieces. In order to assist in the quick disconnection of the tongues 3*a* and 3*b*, respective apertures 5 and 6 are formed centrally disposed in tongues 3*a* and 3*b*. Additionally, the corners of tongues 3*a* and 3*b* may be concavely rounded. The precise design of tongues 3*a* and 3*b* depends upon the construction of the cooperating terminals of the circuit.

Between tongues 3*a* and 3*b*, a narrowed cross-section, here narrow width, mid-section 2 is defined in the strip between the terminals. Mid-section 2 is integral and one piece with and integrally formed with tongues 3*a* and 3*b* and is comprised of the same fusible metal. Mid-section 2 may be narrowed in width during molding or by stamping, by milling, etc. A notch is defined at both sides of the fusible metal element 3. Mid-section 2 may have any shape to have a sufficiently narrow cross-section which will fuse and melt to disconnect tongues 3*a* and 3*b* in response to an electrical overload in the circuit in which the fuse is connected.

The fusible metal mid-section 2 melts in response to an electrical overload. One exemplary electrical system employing the fuse includes a re-chargeable battery and operates a small electric motor, as in a battery-operated household appliance. In such a system, the fusible metal melts on an overload on the order of approximately 180 amps. or greater for preventing a serious, fire or equipment damaging overload. With a small appliance the fuse is designed to operate at currents on the order of up to 400 amps. The fuse may be designed to operate at other current levels by selection of a suitable fusible material The single piece of fusible metal 3 is supported in a housing 7. Housing 7 is preferably comprised of a molded thermoset plastic or thermoplastic material. Any material may be utilized which provides sufficient strength and durability, is not electrically conductive and is not destroyed by the heat of normal use and upon overload. The covering must be stiff enough and large enough to maintain the integrity of the fuse block when the narrowed mid-section 2 of the single piece of fusible metal 3 reacts melts upon an electrical overload and separates tongues 3*a* and 3*b*. Housing 7 covers only portions of tongues 3*a* and 3*b* adjacent mid-section 2, but leaves the whole mid-section 2 exposed so that the housing is not a heat sink for the mid-section 2. A central aperture 8 passing through the housing 7 exposes all of the surfaces of mid-section 2. Housing 7 thereby does not act as a heat sink for fusible element 3, which could interfere with prompt reaction of the fuse to an overload.

Housing 7 may be of two pieces, a top piece 7*a* and a bottom piece 7*b* attached, e.g. glued together by any suitable heat resistant adhesive. Because pieces 7*a* and 7*b* are identical, only one is discussed below. Bottom piece 7*b* is illustrated in FIGS. 6–8. It comprises a plastic block of rectangular cross-section having the above-discussed central aperture 8. Bottom piece 7*b* has upstanding side flanges 9*a* and 9*b* of the same height. Flanges 9*a* and 9*b* define a recess 10 extending longitudinally along the top of bottom piece 7*b* between flanges 9*a* and 9*b*. Recess 10 receives mid-section 2 and adjacent portions of tongues 3*a* and 3*b* when fusible element 3 is placed in housing 7. The depth of recess 10 corresponds to approximately one-half the height of fusible metal element 3 so that fusible element 3 is received in both pieces 7*a* and 7*b*. To manufacture bottom piece 7*b* and top piece 7*a*, a plastic block may be molded as shown. Ultimately, any suitable method of producing the desired configuration of bottom and top pieces 7*a* and 7*b* may be utilized.

The fuse block of the present invention could be used as a backup fuse connected in series with a circuit breaker in a small battery-operated electrical system. It is particularly useful in battery-operated equipment which operate at either 12 volts or 24 volts. It may also be used in a product where a tool is plugged into a battery unit by a wire. The fuse block, however, may be utilized in any application.

Although the present invention has been described in connection with a preferred embodiment, many other variations and modifications will now become apparent to those skilled in the art. It is preferred, therefore, that the present invention be limited not by the specific disclosure herein, but only by the appended claims.

What is claimed is:

1. A fuse block for protecting an electrical system from an electrical overload, comprising:

a fusible metal element having a first terminal in the form of a first tongue and spaced from it a second terminal in the form of a second tongue each tongue being adapted for installation in a disconnect terminal of the electrical system, the fusible metal element having a mid-section between the first and second tongues of a cross-section less than the cross-sections of the tongues, whereby the mid-section is meltable and fusible in response to an electrical overload, the metal element and the tongues being integral, providing a one piece fusible metal element; and a housing for the metal element for providing mechanical integrity between the first and second tongues when the mid-section melts, the housing covering portions of the first tongue and the second tongue near the mid-section, the housing having an aperture exposing the mid-section so that the housing avoids contacting the mid-section for preventing the housing from acting as a heat sink for the mid-section and from interfering with prompt heating of the mid-section due to an electrical overload, the aperture extending through the housing across the mid-section, exposing the mid-section, the fuse block being comprised solely of the fusible metal element and the housing.

2. The fuse block of claim 1, wherein the dimensions of the first tongue and of the second tongue are equal.

3. The fuse block of claim 2, wherein the first tongue and the second tongue are generally rectangular seen in plan view out of the housing.

4. The fuse block of claim 3, wherein the first and the second tongues are substantially flat.

5. The fuse block of claim 4, wherein the tongues have concavely rounded corners at their ends out of the housing.

6. The fuse block of claim 4, wherein the housing is wider than the tongues.

7. The fuse block of claim 1, wherein the first tongue has a first centrally located tongue aperture and the second tongue has a second centrally located tongue aperture to facilitate mounting the tongues in respective disconnect terminals.

8. The fuse block of claim 1, wherein the housing is wider than the tongues.

9. The fuse block of claim 1, wherein the housing is generally rectangular.

10. The fuse block of claim 9, wherein the aperture is located substantially centrally through the housing.

11. The fuse block of claim 1, wherein said aperture is located substantially centrally through the housing.

12. A fuse block for protecting an electrical system from electrical overload, comprising:

a fusible metal element having a first terminal in the form of a first tongue and spaced from it a second terminal in the form of a second tongue each tongue being adapted for installation in a disconnect terminal of the electrical system, the fusible metal element having a mid-section between the first and second tongues of a cross-section less than the cross-sections of the tongues, whereby the mid-section is meltable and fusible in response to an electrical overload; and a housing for the metal element for providing mechanical integrity between the first and second tongues when the mid-section melts, the housing covering portions of the first tongues and the second tongue near the mid-section, the housing having an aperture, the aperture extending through the housing across the mid-section exposing the mid-section so that the housing avoids contacting the mid-section for preventing the housing from acting as a heat sink for the mid-section and from interfering with prompt heating of the mid-section due to an electrical overload, wherein the housing comprises a top piece, a bottom piece and means for affixing the top piece above the metal element and the bottom piece below the metal element, the top and bottom pieces having corresponding longitudinal recesses for receiving the metal element.

13. The fuse block of claim 12, wherein the aperture extends across the housing through the top and the bottom pieces.

14. The fuse block of claim 1, wherein the mid-section has a first end connected to the first tongue and a second end connected to the second tongue, the mid-section having a width narrower than the widths of the tongues.

15. The fuse block of claim 1, wherein the metal element is of zinc.

16. The fuse block of claim 1, wherein the housing comprises an integral housing molded about the fusible metal element.

* * * * *